United States Patent [19]

Sugiyama et al.

[11] Patent Number: 4,680,432

[45] Date of Patent: Jul. 14, 1987

[54] COMPACT ELECTRONIC DEVICE

[75] Inventors: Kazuhiro Sugiyama; Yoshio Kawai, both of Tokyo, Japan

[73] Assignee: Casio Computer Co., Ltd., Tokyo, Japan

[21] Appl. No.: 757,849

[22] Filed: Jul. 22, 1985

[30] Foreign Application Priority Data

Aug. 7, 1984 [JP] Japan ..... 59-165062
Aug. 7, 1984 [JP] Japan ..... 59-165063
Aug. 7, 1984 [JP] Japan ..... 59-0165064

[51] Int. Cl.[4] ..... H01H 3/12

[52] U.S. Cl. ..... 200/5 A; 29/622; 200/159 B; 361/400

[58] Field of Search ..... 200/5 A, 159 B, 264; 340/365 R, 815.2; 361/402, 411; 29/622; 361/398

[56] References Cited

U.S. PATENT DOCUMENTS 4,338,502 7/1982 Hashimoto et al. ..... 200/159 B
4,413,257 11/1983 Kramer et al. ..... 340/815.2
4,451,714 5/1984 Eventoff ..... 200/5 A

FOREIGN PATENT DOCUMENTS 2912049 10/1979 Fed. Rep. of Germany .
3015634 11/1980 Fed. Rep. of Germany .
1255761 12/1971 United Kingdom .
2064873 6/1981 United Kingdom .

*Primary Examiner*—A. D. Pellinen
*Assistant Examiner*—Morris Ginsburg
*Attorney, Agent, or Firm*—Frishauf, Holtz, Goodman & Woodward

[57] ABSTRACT

A key switch structure comprises a first insulating cover having on one surface thereof a first conductive layer and an anisotropically electrical conductive layer printed on the first conductive layer, a second insulating cover having one surface arranged at a side opposite to the anisotropically electrical conductive layer on the first cover member, and a second conductive layer sandwiched between the anisotropically electrical conductive layer and the second insulating cover. At least, one of the first and second insulating covers being flexible. A depression force is selectively introduced from the other surface side of the flexible cover through the anisotropically electrical conductive layer so as to form a conductive path between the first and second conductive layers.

42 Claims, 39 Drawing Figures

COMPACT ELECTRONIC DEVICE

BACKGROUND OF THE INVENTION

This invention relates to a compact electronic device having a key switch structure and, more particularly, to an improvement in an anisotropically electrical key switch structure suitable for compact electronic equipment.

Conventionally, a contact type key switch is adopted as a key switch in electronic equipment such as a compact electronic calculator. A contact type key switch consists of a stationary contact and a movable contact opposing the stationary contact at a given interval and contacting the stationary contact upon depression. Recently, an anisotropical key switch has been proposed. In an anisotropical key switch, an anisotropically electrical conductive rubber sheet is provided on a key contact corresponding to the stationary contact of the contact type key switch and a conductor corresponding to the movable contact thereof is provided on the conductive rubber sheet.

The anisotropically electrical key switch exhibits an insulative property when no pressure is applied thereto, and when a compression force is applied, the compressed portion exhibits conductivity. By utilizing such characteristics of an anisotropically electrical conductive rubber sheet, a conductive layer portion is compressed so as to turn on a switch. In the anisotropically electrical switch of this type, since a gap between the stationary and movable contacts need not be maintained unlike in a contact type key switch, the arrangement of the key switch section of compact electronic equipment can be simplified by utilizing the anisotropically electrical rubber sheet.

However, the anisotropically electrical key switch structure of conventional compact electronic equipment is as follows. A key contact is formed on an upper surface of a printed circuit board on which a predetermined circuit pattern is formed, an anisotropically electrical conductive rubber sheet is overlaid on the key contact, and a conductor opposing the key contact is provided thereon. When the electronic equipment is manufactured, the anisotropically electrical conductive rubber sheet must be aligned and fixed on the printed circuit board. For this reason, assembly of the key switch is cumbersome. When the anisotropically electrical conductive rubber sheet is formed too thin, special handling of the rubber sheet is required when it is fixed on the circuit board, to prevent the rubber sheet from forming wrinkles and being damaged. In order to overcome this drawback, the rubber sheet is formed to be thick (normally 0.5 to 0.1 mm) so as to assure mechanical strength. However, in this case, the key switch section becomes too thick and the equipment cannot be formed to be thin. Although current compact electronic equipment utilizing a contact type key switch is very thin, e.g., of a total thickness of 1 mm or less, if an anisotropically electrical key switch is used and the anisotropically electrical conductive rubber sheet is formed to be 0.5 to 1.0 mm in order to obtain a satisfactory mechanical strength, the total thickness of the equipment becomes too large.

SUMMARY OF THE INVENTION

It is, therefore, an object of the present invention to provide a compact electronic device having a new and improved key switch structure which can be easily manufactured and can be formed thin as compared to a conventional key switch structure even when the key switch is of an anisotropically electrical type.

According to the present invention, there is provided a compact electronic device having a key switch structure comprising:

a first insulating cover means having on one surface thereof a first conductive layer and an anisotropically electrical conductive layer printed on the first conductive layer;

a second insulating cover means having one surface arranged at a side opposite to the anisotropically electrical conductive layer on the first insulating cover means; and a second conductive layer sandwiched between the anisotropically electrical conductive layer and the second insulating cover means, at least one of said first and second insulating cover means having flexibility, and a depression force being selectively exerted from the other surface side of the flexible cover means through the anisotropically electrical conductive layer so as to form a conductive path between said first and second conductive layers.

BRIEF DESCRIPTION OF THE DRAWINGS

These and other objects and features of the present invention can be understood by reference to the accompanying drawings, in which.

DETAILED DESCRIPTION OF THE PREFERRED EMBODIMENTS

A compact electronic calculator according to embodiments of the present invention will be described with reference to the accompanying drawings.

Figure 2:
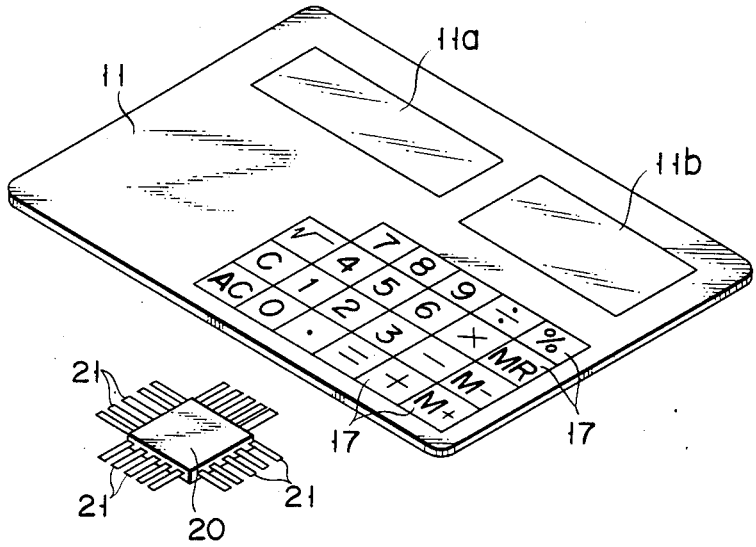
FIG. 2 is an exploded view of the compact electronic calculator shown in FIG. 1.
Figure 2:
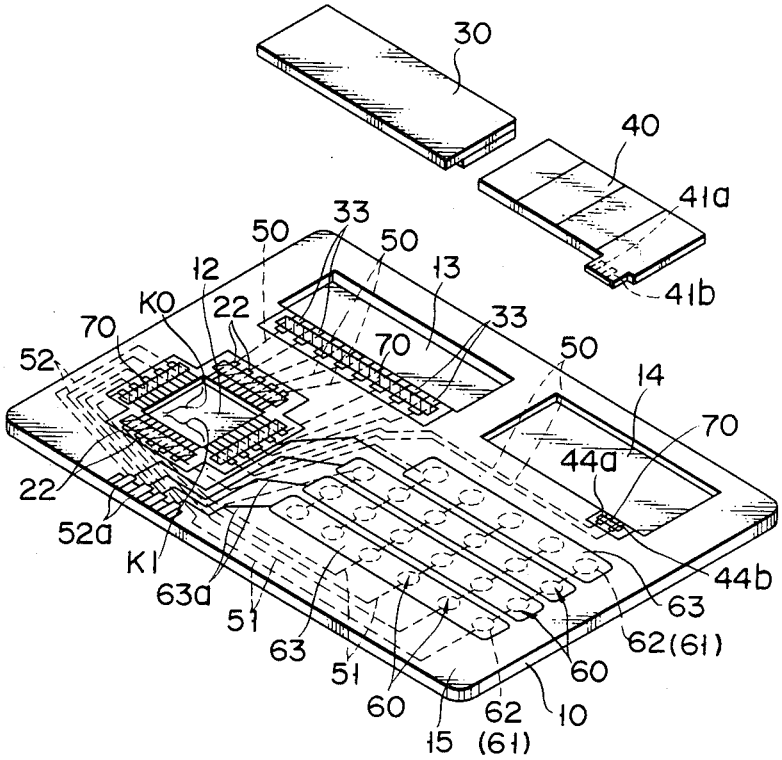

Referring to FIGS. 1 to 6 showing a first embodiment, reference numeral 10 denotes a lower cover of a compact electronic calculator; and 11, an upper cover, flexible thin sheet member forming an upper surface of the compact electronic calculator. The lower cover 10 is an insulating cover means, e.g., a rigid flat member of synthetic resin. As shown in FIG. 2, recess portions 12, 13 and 14 are formed by half etching an upper surface of the lower cover 10 so that a large scale integrated circuit chip (to be referred to as an LSI chip hereinafter) 20, a display, e.g., a liquid crystal display panel 30, and a solar cell 40 are fitted therein. LSI connecting terminals 22 are aligned around the recess portion 12. Display panel connecting terminals 33 are aligned at one side of the recess portion 13. Furthermore, a pair of cell connecting terminals 44*a* and 44*b* are formed at a side portion of the recess portion 14. The terminals 33, 44*a* and 44*b* are connected to the terminals 22 through wirings 50 formed on the upper surface of the lower cover 10.

Hot-melt type anisotropic conductive adhesives 70 are printed on the aligning portions of the terminals 22, 33, 44*a* and 44*b*.

The LSI chip 20 is fitted in the recess portion 12 of the lower cover 10, and is held by the lower cover 10. Terminals 21 of the chip 20 are overlaid on the terminals 22 through the adhesive 70 and are hot-pressed so as to be adhered thereto with the adhesive 70. Note that the anisotropic conductive adhesive can be adhered so that hot-pressed portions (a portion between each two adjacent terminals) become conductive along a film thickness direction.

Figure 1:
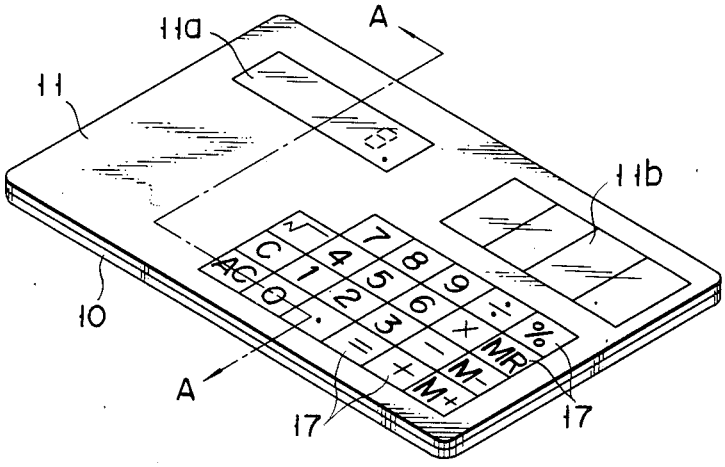
FIG. 1 is a perspective view of a compact electronic calculator according to a first embodiment of the present invention.
Figure 3:
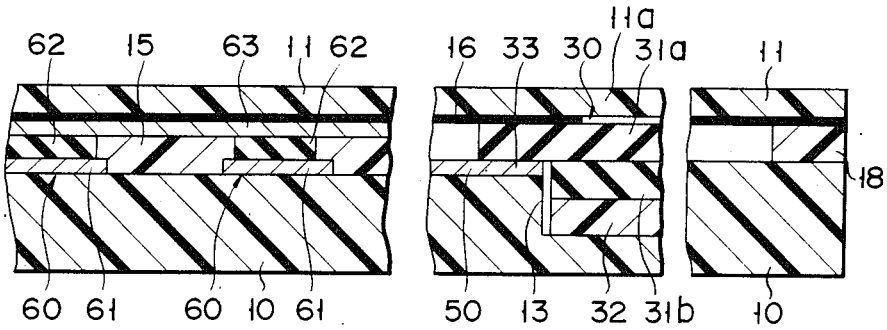
FIG. 3 is an enlarged sectional view taken along a line A—A of FIG. 1.

As shown in a partial sectional view of FIG. 3, the panel 30 is constituted in such a manner that a liquid cyystal material is filled between upper and lower tansparent electrode substrates 31*a* and 31*b*, and a reflecting plate 32 is adhered to a lower surface of the electrode assembly. A portion below the upper electrode substrate 31*a* of the panel 30 is fitted in the recess portion 13, and is held by the lower cover 10. Terminals (not shown) of the panel 30 aligned at one side of the lower surface of the substrate 31*a* are overlaid on the terminals 33 through the adhesive 70 and are hot-pressed so as to be adhered thereto with the adhesive 70.

The cell 40 is fitted in the recess portion 14 and is held by the lower cover 10. A pair of terminals 41*a* and 41*b* of the cell 40 are overlaid on the terminals 44*a* and 44*b* through the adhesive 70 and are hot-pressed so as to be adhered thereto with the adhesive 70.

Referring to FIG. 2, reference numeral 60 denotes the input anisotropically electrical key switches arranged in a matrix form on the upper surface of the lower cover 10, as will be described later. The switches 60 consist of 23 key contacts 61 formed on the upper surface of the lower cover 10, circular anisotropically electrical conductive layers 62 printed to be overlaid on the contacts 61, and upper conductive layers 63 (four in FIG. 2) printed to oppose the contacts 61 of each row. The contacts 61 of the switches 60 are commonly connected for each column, as shown in FIG. 2, and are connected to a key signal input terminal group KI of the terminals 22 through wirings 51 formed on the upper surface of the lower cover 10.

The upper surface of the lower cover 10 is covered with an insulating synthetic resin adhesive layer 15 excluding the contacts 61, the layers 62, the recess portions 12, 13 and 14 for fitting the electronic parts (the LSI chip 20, the panel 30 and the cell 40) therein and the terminals 22, 33, 44*a* and 44*b*. In this case, the layers 62 are formed on the contacts 61 so as to have the same level as the insulating layer 15.

Each layer 63 is printed on the insulating layer 15 perpendicularly to the key contact columns so as to cover the layers 62 of the respective key contact columns, thus forming a key matrix together with the contacts 61. The layers 63 are connected to a key signal output terminal group KO of the terminals 22 in the following manner.

Referring to FIG. 2, reference numeral 52 denotes upper conductive layer connecting wirings connected from the terminal group KO to one side edge portion of the lower cover 10. The wirings 52 are covered with the insulating layer 15 excluding terminal portions 52*a*. Reference numeral 63*a* denotes leads of the layers 63 printed on the upper surface of the insulating adhesive 15. The layers 63 are connected to the terminal group KO of the terminals 22 through the wirings 52 in such a manner that edge portions of the leads 63*a* are printed to be overlaid on the terminal portions 52*a* of the wirings 52.

FIGS. 4A to 4D and FIGS. 5A to 5D show manufacturing steps of the anisotropically electrical key switches 60 formed on the upper surface of the lower cover 10. The switches 60 are formed in the following manner.

Figure 4A:
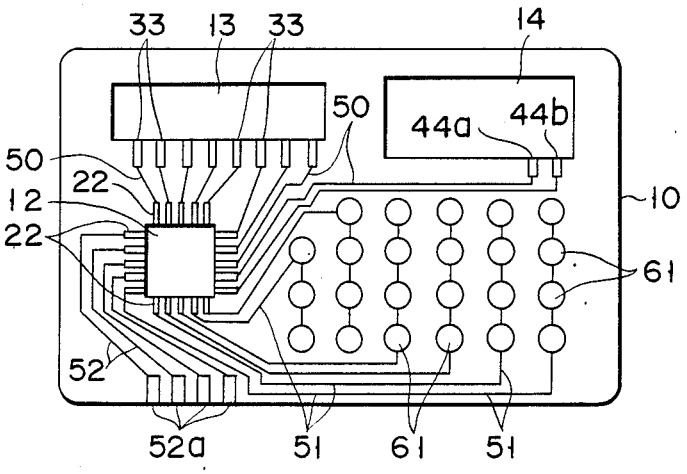
FIGS. 4A to 4D and FIGS. 5A to 5D are respectively plan views and enlarged sectional views showing manufacturing steps of an anisotropically electrical key switch section of FIG. 2.
Figure 5A:
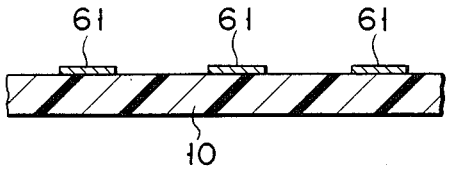

As shown in FIGS. 4A and 5A, a predetermined circuit pattern (wirings 50, 51 and 52) including the key contacts 61 of the switches 60, the terminals 22, 33, 44*a* and 44*b* is formed on the upper surface of the lower cover 10 by screen printing of carbon ink. The circuit pattern can alternatively be formed in such a manner that a copper foil is laminated on the overall surface of the lower cover 10 and then is patterned by etching.

Figure 4B:
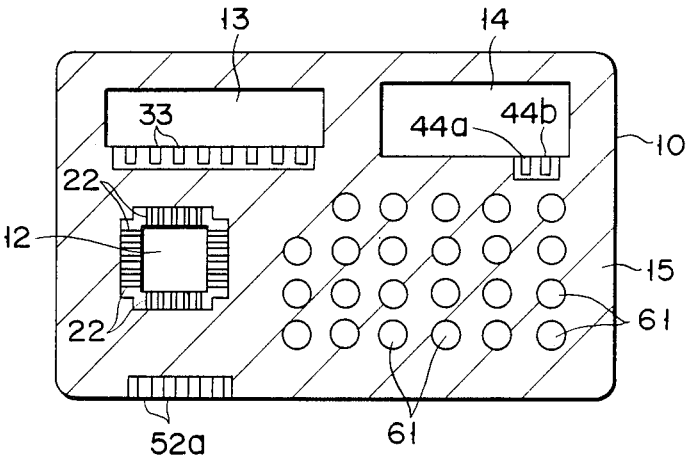
Figure 5B:
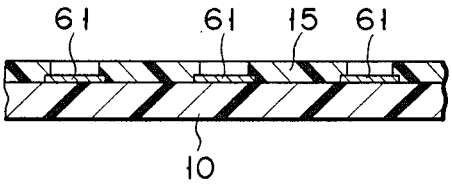

As shown in FIGS. 4B and 5B, an insulating synthetic resin adhesive is printed on the overall surface of the lower cover 10 excluding the key contacts 61, the recess portions 12, 13 and 14 for fitting the electronic parts (the chip 20, the panel 30 and the cell 40) therein, the terminals 22, 33, 44*a* and 44*b*, and the terminal portions 52*a* of the wirings 52, thereby forming the insulating adhesive layer 15. The insulating adhesive layer 15 is formed to protect the wirings 50, 51 and 52 and to insulate the wirings 50, 51 and 52 from the leads 63*a* of the upper conductive layers 63, and has a thickness of about 30 μm.

Figure 4C:
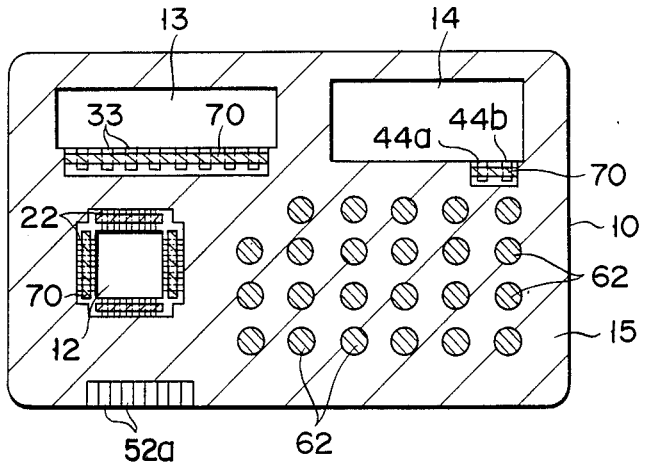
Figure 5C:
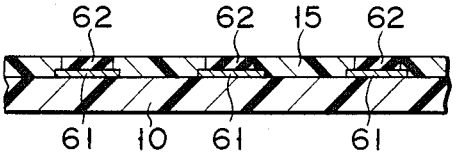

As shown in FIGS. 4C and 5C, the anisotropically electrical conductive layers 62 are printed by screen printing on the key contacts 61 which are not covered with the insulating layer 15 to obtain the same thickness (about 30 μm) as that of the insulating layer 15. In addition, the anisotropically electrical conductive adhesives 70 are printed on the aligning portions of the terminals 22, 33, 44*a* and 44*b*.

When the layers 62 are formed, a rubber material such as silicone rubber or chloroprene rubber is mixed with a thermoplastic resin, a solvent and a tackifier are added to the resultant mixture and are dissolved to obtain an insulative polymeric material. Conductive particles such as nickel (fine particles having a particle size of about 10 μm) are mixed with the polymeric material and are dispersed. The conductive particles are mixed with the insulative polymeric material at a mixing ratio obtained immediately before the polymeric material exhibits conductivity due to mixture and dispersion of the particles (i.e., when conductive particles are mixed with an insulative material, a resistance of the insulative material is abruptly decreased when the mixing ratio of the particles exceeds a predetermined value, and the insulative material is converted into a conductive material). Therefore, the layers 62 exhibit an insulative property when no compression force is applied thereto. However, when a compression force is applied, the conductive particle density of the compressed portion is increased, and this portion exhibits conductivity. Thus, when the compression force is released, the compressed portion recovers, and again exhibits insulative property.

Figure 4D:
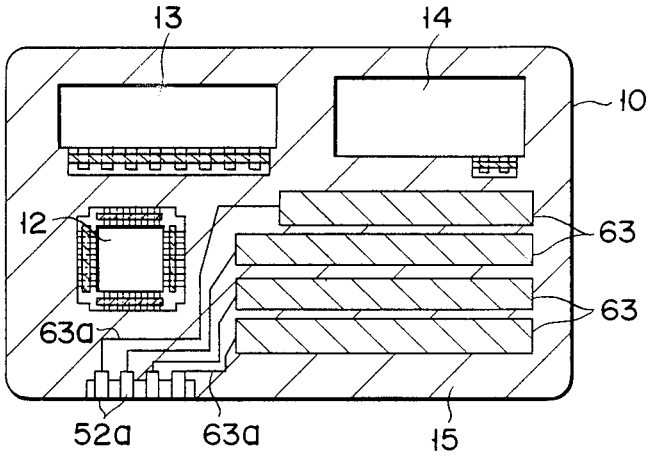
Figure 5D:
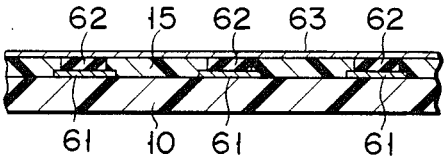

Thereafter, as shown in FIGS. 4D and 5D, the carbon ink is printed on the upper surface of the insulating layer 15 by screen printing, thus forming the upper conductive layers 63 covering the layers 62 of respective key contact columns and the leads 63*a* thereof. In this case, the edge portions of the leads 63*a* are printed so as to be overlaid on the terminal portions 52*a* of the wirings 52 so that the layers 63 are connected to the terminal group KO of the terminals 22 through the wirings 52.

Note that when the layers 62 are formed, the adhesives 70 are printed on the aligning portions of the terminals 22, 33, 44*a* and 44*b*. However, the adhesives 70 can be printed after the layers 63 are formed.

As shown in FIG. 3, the upper cover 11 is formed in such a manner that a mask printing layer 16 is formed on a back surface of a flexible insulating cover means such as a transparent resin sheet excluding a display window 11*a* facing a display surface of the panel 30 and a light receiving window 11*b* opposing a light receiving surface of the cell 40 (see FIG. 3), and key symbols 17 are printed on a front surface of the resin sheet so as to correspond to the respective key switches 60. The upper cover 11 is overlaid on the lower cover 10 so as to cover the respective electronic parts 20, 30 and 40 and the key switch portion (see FIG. 2), and a peripheral portion thereof is adhered to the lower cover 10 by an adhesive 18, as shown in FIG. 3.

The key switch structure applied to the compact electronic calculator is formed in such a manner that the anisotropically electrical conductive layers 62 are printed on the key switches 60 in the lower cover 10 having the upper surface on which the predetermined circuit pattern including the key contacts 61, the terminals 22, 33, 44*a* and 44*b* is formed, and the upper conductive layers 63 are printed on the layers 62. Thereafter, the LSI chip 20, the panel 30 and the cell 40 are fitted in the recess portions 12, 13 and 14 of the lower cover 10, respectively, and these electronic parts 20, 30 and 40 are connected to the terminals 22, 33, 44*a* and 44*b* of the lower cover 10. Thereafter, the upper cover 11 is adhered to the lower cover 10, thus manufacturing the compact electronic calculator.

When the desired key symbol 17 of the upper cover 11 is depressed to deflect the cover 11 downward, the corresponding layer 62 is compressed and exhibits the conductivity. Therefore, a conductive path is formed between the corresponding key contact 61 and the layer 63, thereby selectively turning on the corresponding switch 60. In this case, a keying signal is supplied to the LSI chip 20 through the respective wirings and terminals, and is used for a desired calculation. In addition, the keying signal is used for displaying the corresponding calculation result on the panel 30.

In this case, the key contacts 61 and the layers 62 and 63 constituting the key switches 60 are sequentially printed on the upper surface of the lower cover 10 so as to overlap each other. For this reason, the key switch structure of the present invention allows easy assembly as compared to a conventional key switch structure in which anisotropically electrical rubber sheets are aligned to overlap each other.

In the key switch structure of this embodiment, since the layers 62 are formed by printing, they need not be formed thick to prevent formation of wrinkles or damage unlike the anisotropically electrical conductive rubber sheet considered as one component. Therefore, since the layers 62 can be formed thin, the total thickness of the key switch, and hence, the compact electronic calculator can be greatly decreased.

Note that in the first embodiment, the upper cover 11 is used as an upper case means. The upper case can be formed by coating a resin. In this case, portions covering the display surface of the panel 30 and the light receiving surface of the cell 40 are coated with a transparent resin and the remaining portion is coated with a nontransparent resin.

Figure 6:
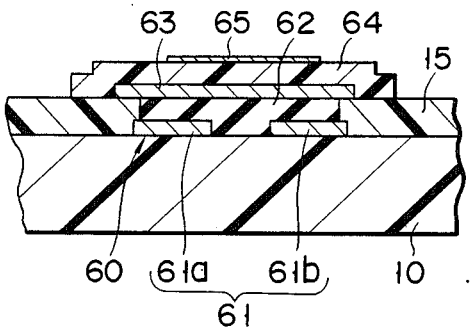
FIG. 6 is an enlarged sectional view showing a modification of the anisotropically electrical key switch section of FIG. 2.
Figure 7:
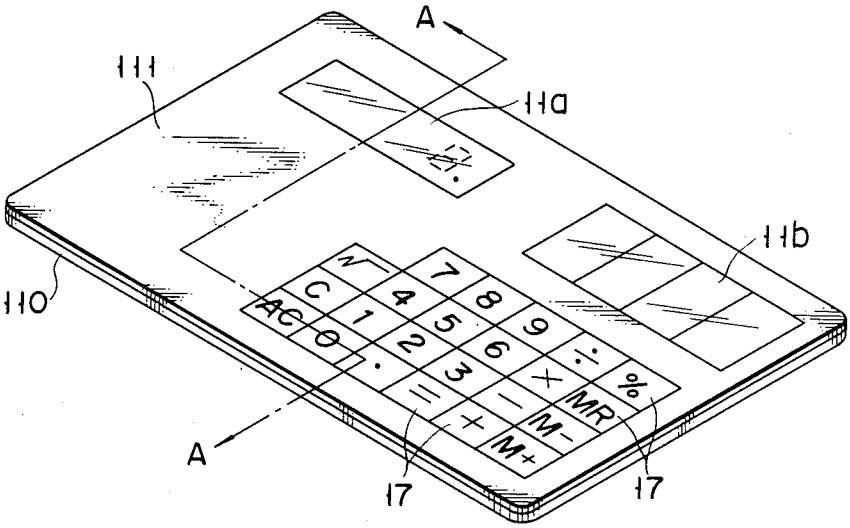
FIG. 7 is a perspective view of a compact electronic calculator according to a second embodiment of the present invention.

Furthermore, in the first embodiment, the key contacts 61 of the switches 60 are connected to the terminal group KI, and the layers 63 are connected to the terminal group KO of the chip 20. However, as shown in FIG. 6, the switches 60 on the lower cover 10 can be formed by a pair of contact electrodes (ex, comb figure electrode) 61*a* and 61*b*. The electrodes 61*a* are connected to the terminal group KI of the chip 20 and the electrode 61*b*, to the terminal group KO of the chip 20. The electrodes 61*a* and 61*b* will be electrically connected to the upper conductive layer 63 formed theron, through the anisotropically electrical conductive layers 62. In this case, since a lead need not be connected from the layers 63, the layers 63 are coated with an insulative resin, respectively, and key symbols 65 are printed on the upper surface of a coating film 64. Thus, only portions on which electronic parts such as an LSI chip and a liquid crystal display panel are arranged can be covered by the upper sheet or the resin coating film.

Figure 8:
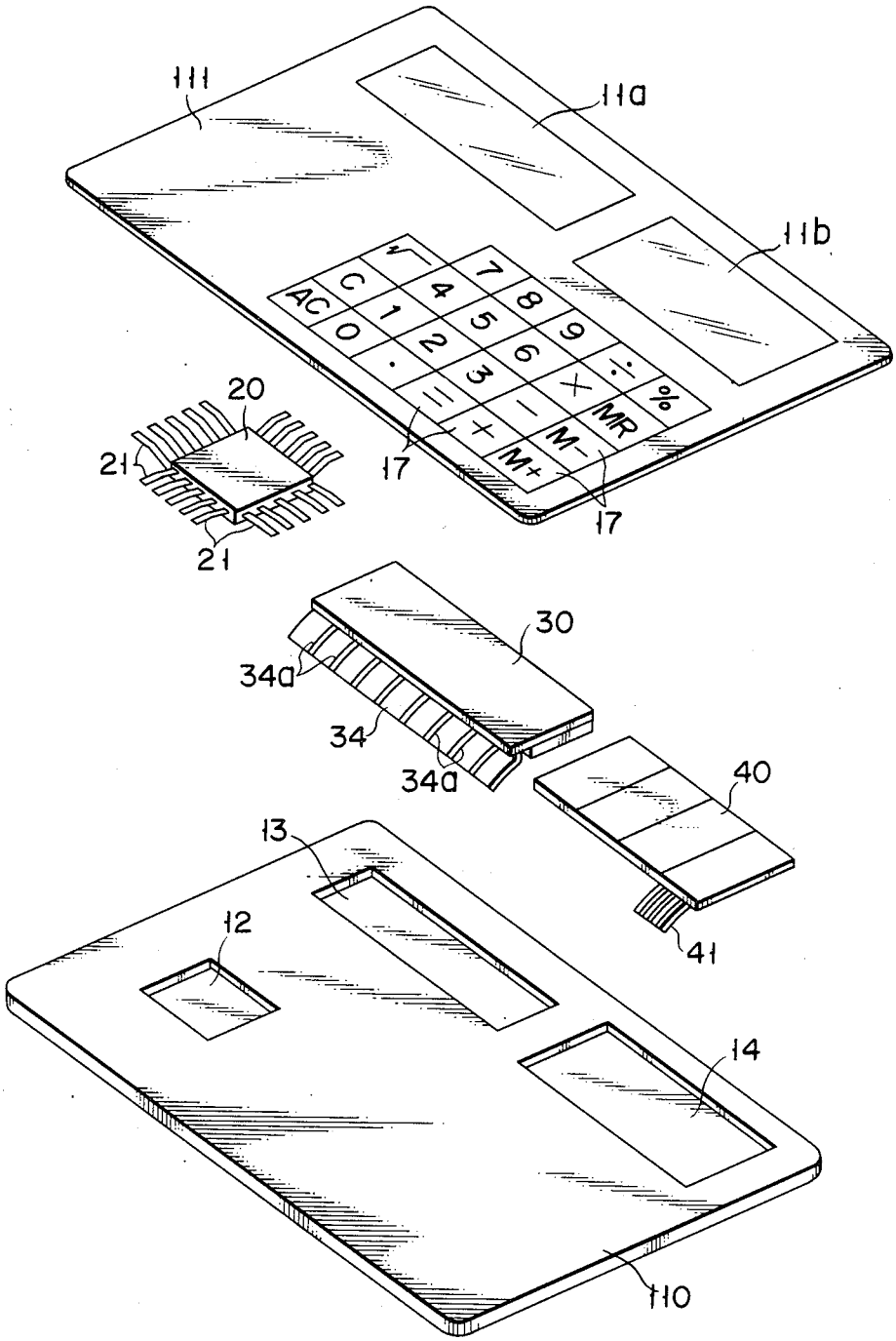
FIG. 8 is an exploded view of the compact electronic calculator shown in FIG. 7.

A second embodiment of the present invention will be described. Referring to FIGS. 7 to 10, reference numeral 110 denotes a lower cover of a compact electronic calculator; and 111, an upper cover forming an upper surface of the electronic calculator. The lower cover 110 is an insulating cover means such as a flat member of synthetic resin. As shown in FIG. 8, recess portions 12, 13 and 14 are formed by half etching the upper surface of the lower cover 110 for storing a large scale integrated circuit chip (to be referred to as an LSI chip hereinafter) 20, a display such as a liquid crystal display panel 30, and a solar cell 40.

Figure 9:
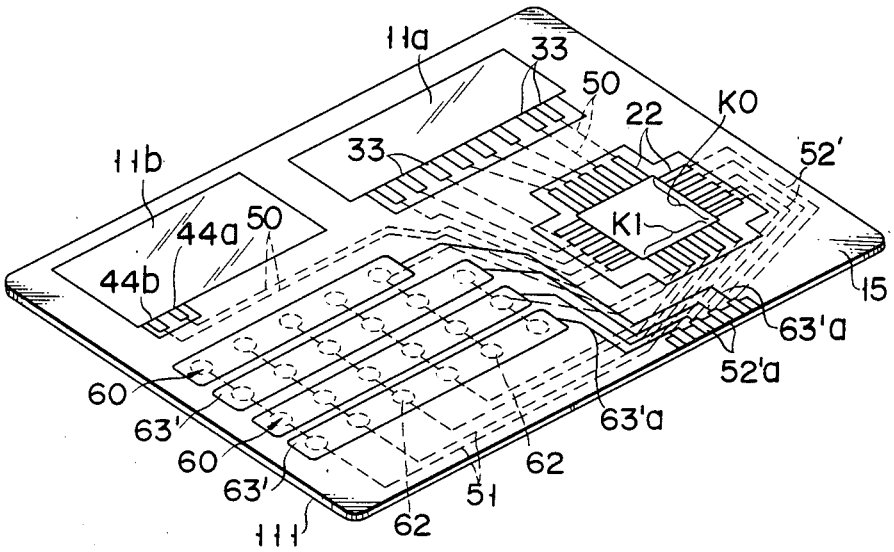
FIG. 9 is a perspective view from a lower surface side of an upper sheet of FIG. 7.

The upper cover 111 is formed in such a manner that a mask printing layer 16 is formed on a lower surface of a flexible insulating sheet, e.g., a transparent resin sheet excluding a display window 11*a* facing a display surface of the panel 30 and a light receiving window 11*b* facing a light receiving surface of the cell 40 (see FIG. 8). Key symbols 17 corresponding to anisotropically electrical key switches (to be described later) are printed on the upper surface or lower surface (i.e., between the mask printing 16 and the upper cover 111) of the upper cover 111. As shown in FIG. 9, LSI chip connecting terminals 22 are aligned on the lower surface of the upper cover 111 so as to surround an opening for the chip 20. Display panel connecting terminals 33 are formed at one side of the window 11*a*. Furthermore, a pair of cell connecting terminals 44*a* and 44*b* are formed on a side portion of the window 11*b*. The terminals 33, 44*a* and 44*b* are connected to the LSI chip 20 through wirings 50 formed on the upper surface of the lower cover 110.

The LSI chip 20 is mounted on the upper cover 111 such that terminals 21, printed conductive adhesives such as corbon ink (not shown) thereof, are adhered to the terminals 22. A lower portion of the LSI chip 20 is fitted in the recess portion 12 of the lower cover 110.

Figure 10:
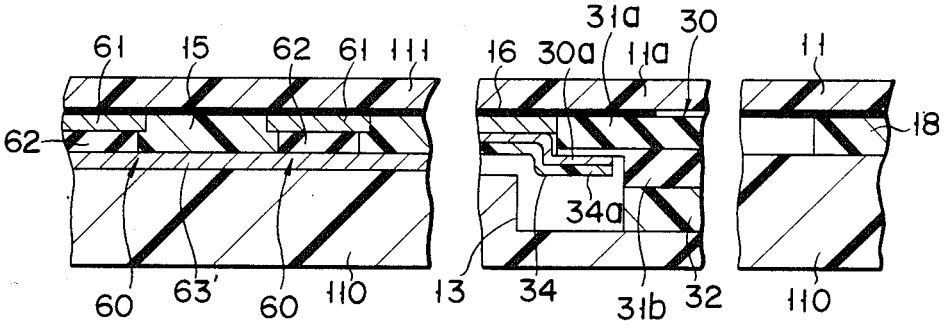
FIG. 10 is an enlarged sectional view taken along a line A—A of FIG. 7.

As shown in a partial sectional view of FIG. 10, the liquid crystal panel 30 consists of a pair of upper and lower transparent electrode substrates 31*a* and 31*b*, a liquid crystal material (not shown) filled therebetween, and a reflecting plate 32 adhered to a lower surface of the substrate assembly. The panel 30 is mounted on the upper cover 111 in such a manner that a film-like heat seal connector 34 adhered to the terminal aligning portion on a side portion of a lower surface of the upper electrode substrate 31*a* is adhered and connected to the terminals 33. The lower electrode substrate portion of the panel 30 is fitted in the recess portion 13 of the lower cover 110. Note that the connector 34 is formed by printing hot-melt type conductive adhesives 34*a* on one surface of a resin film so as to obtain an alignment corresponding to terminals 30*a* (see FIG. 10) aligned in the terminal aligning portion of the panel 30 and the terminals 33 on the upper cover 111.

The solar cell 40 is mounted on the upper cover 111 such that a film-like heat seal connector 41 adhered to the terminal portion thereof is adhered and connected to the terminals 44*a* and 44*b*. A lower portion of the cell 40 is fitted in the recess portion 14 of the lower cover 110.

Note that a peripheral portion of the upper cover 111 is adhered to the lower cover 110 by an adhesive 18.

Furthermore, reference numeral 60 denotes anisotropically electrical key switches for an input operation aligned on the lower surface of the upper cover 111. The switches 60 are constituted by key contacts 61 formed to face printed portions of the key symbols 17, anisotropically electrical conductive layers 62 formed on (the lower surface of) the key contacts 61, and lower conductive layers 63' formed on (the lower surfaces of the layers 62) so as to oppose the contacts 61. The contacts 61 of the switches 60 are commonly connected for each column, and the commonly connected switches 61 are connected to a key signal input terminal group KI of the terminals 22 through wirings 51 formed on the upper surface of the lower cover 110, as shown in FIG. 9.

The lower surface of the upper cover 111 is covered with an insulating synthetic resin adhesive layer 15 excluding the contacts 61, recess portions of the electronic parts (the LSI chip 20, the panel 30 and the cell 40) and the terminals 22, 33, 44*a* and 44*b*. The layers 62 are formed to have the same level as the film 15.

The layers 63' are printed on the insulating layer 15 perpendicularly to the key contact columns so as to cover the layers 62 of each key contact column, thus forming a key matrix together with the key contacts 61 of each column. The layers 63' are connected to the terminal group KO of the terminals 22 in the following manner.

Referring to FIG. 9, reference numeral 52' denotes lower conductive layer connecting wirings connected from a key signal output terminal group KO to one side edge portion of the lower cover 110. The wirings 52' are also covered with the insulating layer 15 excluding terminal portions 52'*a* thereof. Reference numeral 63'*a* denotes leads of the layers 63' printed on the upper surface of the insulating layer 15. The layers 63' are connected to the terminal group KO of the terminals 22 through the wirings 52' in such a manner that edge portions of the leads 63'*a* are printed to be overlaid on the terminal portions 52'*a* of the wirings 52'.

FIGS. 11A to 11D and FIGS. 12A to 12D show manufacturing steps of the anisotropically electrical key switches 60 formed on the upper surface of the lower cover 110. The switches 60 are formed in the following manner.

Figure 11A:
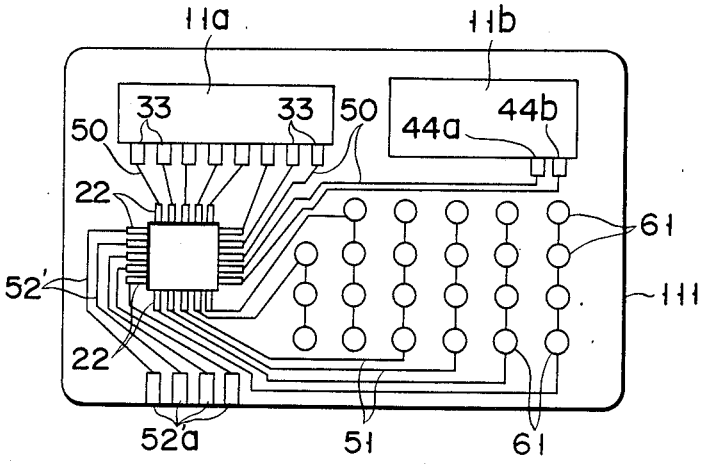
FIGS. 11A to 11D and FIGS. 12A to 12D are respectively plan views and enlarged sectional views showing manufacturing steps of an anisotropically electrical key switch section of FIG. 9.
Figure 12A:
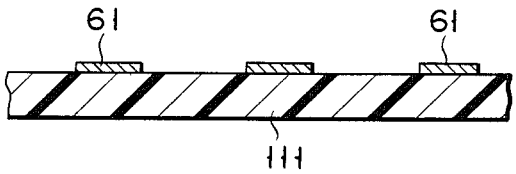

As shown in FIGS. 11A and 12A, a predetermined circuit pattern (wirings 50, 51 and 52') including the key contacts 61 of the switches 60, the terminals 22, 33, 44*a* and 44*b* is formed on the lower surface of the upper cover 111 by screen printing.

Figure 11B:
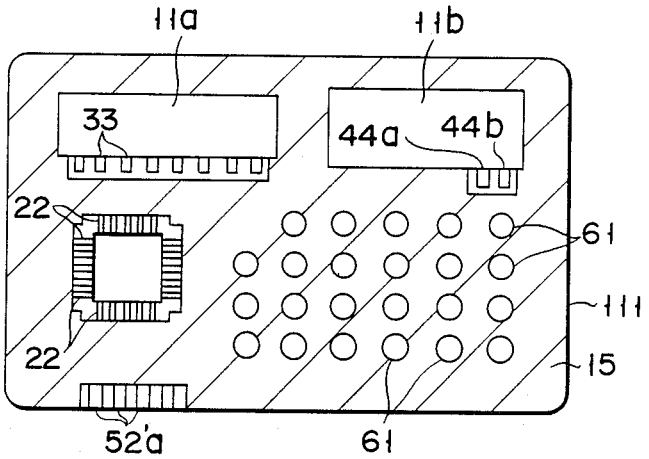
Figure 12B:
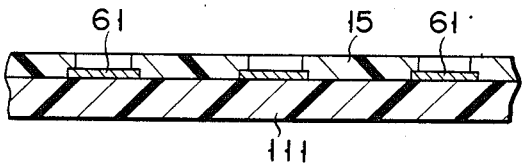

As shown in FIGS. 11B and 12B, an insulating synthetic resin film is printed on the overall lower surface of the upper cover 111 excluding the key contacts 61, the recess portions of the electronic parts (the LSI chip 20, the panel 30 and the cell 40) and the terminals 22, 33, 44*a* and 44*b*, thus forming the insulating layer 15. The insulating layer 15 is provided to protect the wirings 50, 51 and 52' formed on the upper cover 111 and to insulate the wirings 50, 51 and 52' from the leads 63'*a* of the lower conductive layers 63'. Therefore, the layer 15 can have a thickness of about 30 μm.

Figure 11C:
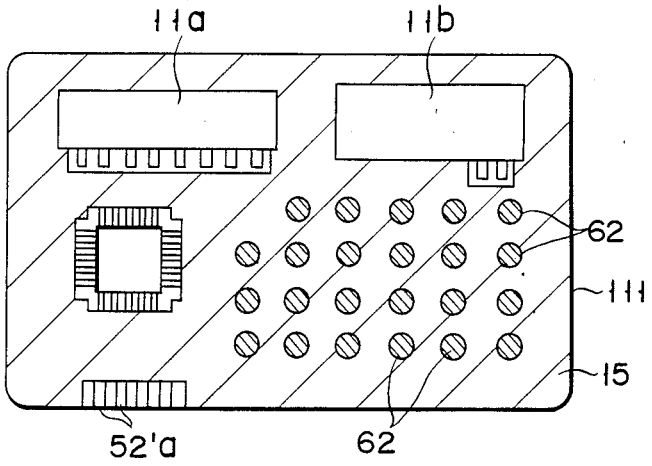
Figure 12C:
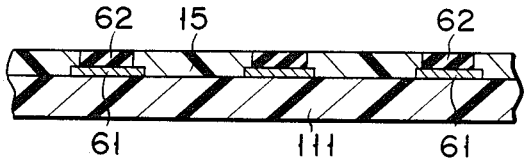

As shown in FIGS. 11C and 12C, the anisotropically electrical conductive layers 62 are printed on the key contacts 61 which are not covered with the layer 15 by screen printing so as to have the same thickness (about 30 μm) as that of the layer 15.

The layers 62 comprise the same composition and function as in the first embodiment.

Figure 11D:
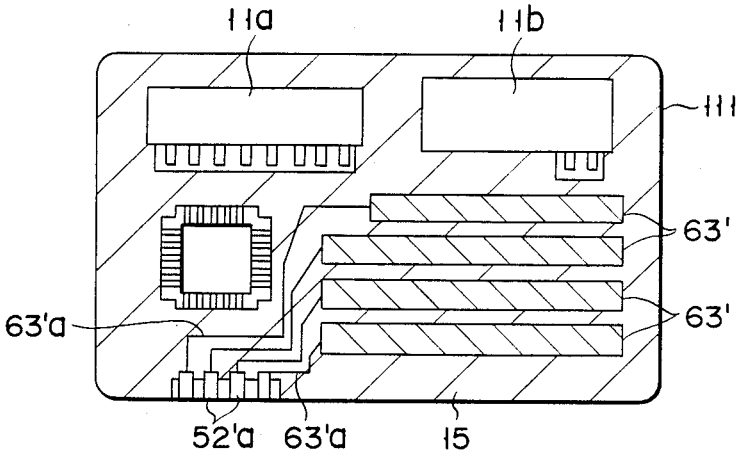
Figure 12D:
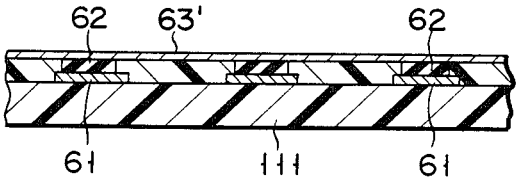
Figure 13:
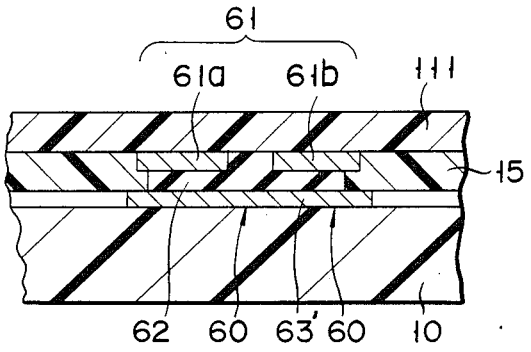
FIG. 13 is an enlarged sectional view showing a modification of the anisotropically electrical key switch of FIG. 9.

Thereafter, as shown in FIGS. 11D and 12D, carbon ink is screen printed on the upper surface of the film 15 so as to form the lower conductive layers 63' for covering the layers 62 of the respective key contact columns, and the leads 63'*a* thereof. In this case, the edge portions of the leads 63'*a* are printed to be overlaid on the terminal portions 52'*a* of the wirings 52', so that the layers 63' are connected to the key signal output terminal group KO of the terminals 22 through the wirings 52'.

Note that the compact electronic calculator is manufactured as follows. The LSI chip 20, the panel 30 and the cell 40 are mounted on the upper cover 111 having the lower surface on which the predetermined circuit pattern including the terminals 22, 33, 44*a* and 44*b* is formed, and the key switches 60 are formed as described above. Thereafter, the upper cover 111 is adhered to the lower cover 110.

When the desired key symbol 17 of the upper cover 111 is depressed to deflect the upper cover 111 downward, the corresponding layer 62 is compressed and exhibits conductivity. Therefore, a conductive path is formed between the corresponding key contact 61 and the layer 63, thereby selectively turning on the corresponding switch 60. In this case, a keying signal is supplied to the LSI chip 20 through the respective wirings and terminals, and is used for a desired calculation. In addition, the keying signal is used for displaying the corresponding calculation result on the panel 30.

According to the key switch structure of this embodiment, since the key switches 60 are formed by sequentially printing the key contacts 61, the layers 62 and the layers 63' on the lower surface of the upper cover 111, the key switches can be easily formed in comparison with a conventional key switch structure in which anisotropically electrical conductive rubber sheets are aligned to be stacked. Therefore, assembly of the compact electronic calculator can be easily performed.

According to the key switch structure of this embodiment, since the layers 62 are formed by printing in the same manner as in the first embodiment, they need not be formed thick to prevent formation of wrinkles or damage unlike the anisotropically electrical conductive rubber sheet considered as one component. Therefore, the layers 62 can be formed thin and a total thickness of a key switch can be greatly decreased, resulting in a very thin compact electronic calculator.

Note that in the second embodiment, the key contacts 61 of the key switches 60 are connected to the key signal input terminals of the LSI chip 20 and the lower conductive layers 63' are connected to the key signal output terminals of the chip 20. However, the key contacts 61 of the switches 60 can be formed by a pair of contact electrodes (ex, comb figure electrodes) 61*a* and 61*b* and the electrodes 61*a* are connected to the key signal input terminals of the LSI chip 20 and the electrodes 61*b*, to the key signal output terminals of the LSI chip 20. Thus, the electrodes 61*a* and 61*b* are made conductive to each other through the layers 62 and the layers 63' formed thereon. Note that in this case, no lead is required for the.layers 63'.

A third embodiment of the present invention will be described hereinafter. Referring to FIGS. 14 to 17, reference numeral 110 denotes a lower cover of a compact electronic calculator; 11, an upper cover forming an upper surface of the electronic calculator; and 211, a printed circuit board arranged on the upper surface of the lower cover 110. The lower cover 110 has substantially a flat shape having an upper surface which is recessed except for a peripheral portion and is made of an insulating cover means, e.g., a synthetic resin. As shown in FIG. 15, recess portions 12, 13 and 14 for housing a large scale integrated circuit chip (to be referred to as an LSI chip hereinafter) 20, a display, e.g., a liquid crystal display panel 30 and a solar cell 40 are formed in the upper surface of the lower cover 110.

The printed circuit board 211 is made of a flexible insulating sheet, e.g., a resin film. The board 211 has a size suitable for arrangement on the upper surface of the lower cover 110 together with the panel 30 and the cell 40.

Figure 16:
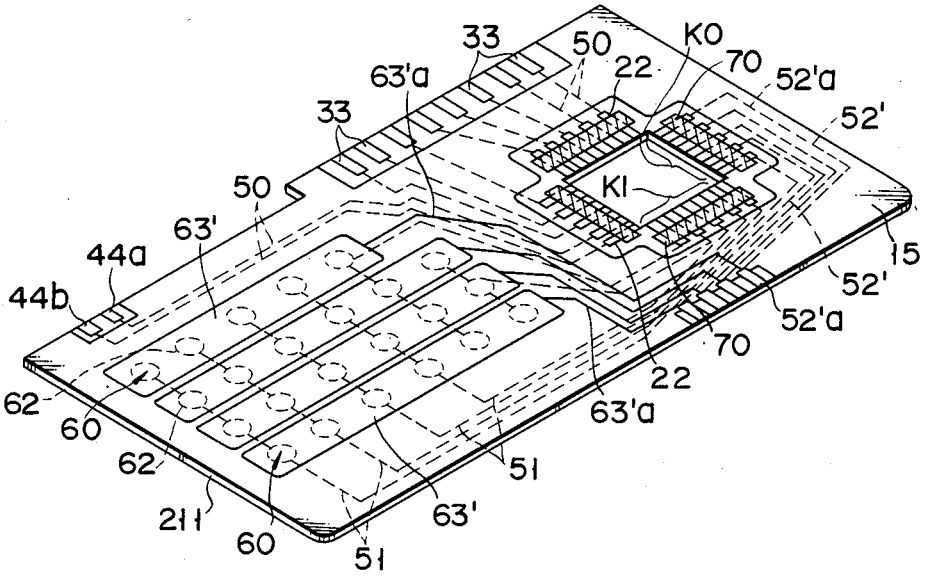
FIG. 16 is a perspective view from a lower surface side of a printed circuit board of FIG. 15.

An opening 112*a* for fitting the LSI chip 20 therein is formed in the board 211. As shown in FIG. 16, LSI chip connecting terminals 22 are aligned around the opening 12*a* on the lower surface of the board 211. Hot-melt type anisotropic conductive adhesives 70 are printed on the aligning portions of the terminals 22.

Display panel connecting terminals 33 and a pair of cell connecting terminals 44*a* and 44*b* are formed on the side edge portion of the lower surface of the board 211. The terminals 33, 44*a* and 44*b* are connected to the terminals 22 through wirings 50 formed on the board 211.

The LSI chip 20 is fitted in the opening 112*a* of the board 211 and the extending portion thereof below the board 211 is fitted in the recess portion 12 of the lower cover 110. Terminals 21 of the LSI chip 20 are overlaid on the terminals 22 through the adhesives 70 and are hot-pressed so as to be connected thereto with the adhesives 70. Note that only hot-pressed portions of the anisotropic conductive adhesive (i.e., a portion between each two adjacent terminals) exhibits conductivity along a film thickness direction.

Figure 17:
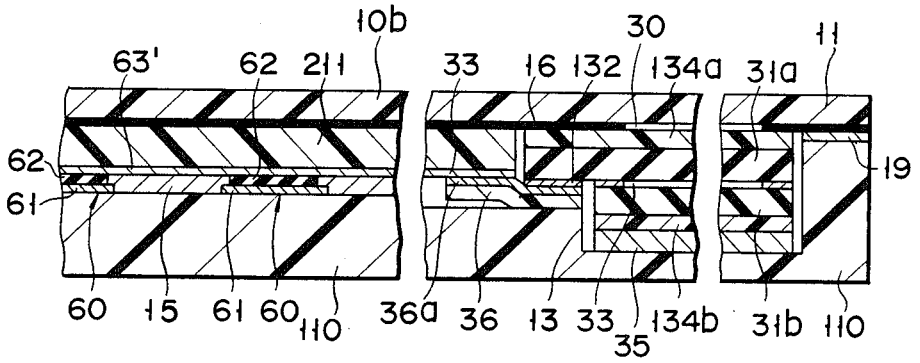
FIG. 17 is an enlarged sectional view taken along a line A—A of FIG. 14.

As shown in a sectional view of FIG. 17, the panel 30 is of a TN type in which a liquid crystal material is filled between a pair of upper and lower transparent electrode substrates 31*a* and 31*b* adhered through a seal member 132, polarizing plates 134*a* and 134*b* are formed on the outer surfaces of the substrates 31*a* and 31*b*, and a reflection plate 35 is provided on the lower surface of the substrate assembly. A portion of the panel 30 below the substrate 31*a* thereof is fitted in the recess portion 13 of the lower cover 110 and is arranged at a side portion of the board 211. The panel 30 is connected to the terminals 33 so that a film-like heat seal connector 36 adhered to the terminal aligning portion of the substrate 31*a* is adhered to the display panel connecting terminal aligning portion. Note that the connector 36 is formed by printing on one surface of a resin film hot-melt type conductive adhesives 36*a* in an alignment corresponding to terminals 30*a* aligned on the terminal aligning portion of the panel 30 and the terminals 33 of the board 211.

The cell 40 is fitted in the recess portion 14 of the lower cover 110 so as to be arranged at a side portion of the board 211. The cell 40 is connected to the terminals 44*a* and 44*b* so that a film-like heat seal connector 41 adhered to the terminal portion thereof is adhered to the cell connecting terminal forming portion of the board 211.

On the other hand, the upper cover 11 is made of a flexible insulating cover means, e.g., a transparent resin sheet. A mask printing layer 16 (FIG. 17) is formed on the lower surface of the upper cover 11 excluding a display window 11*a* facing the display surface of the panel 30 and a light receiving window 11*b* facing the light receiving surface of the cell 40. Key symbols 17 corresponding to the key switches are printed on the upper surface or lower surface (i.e., between the mask printing layer 16 and the upper cover 11). The upper cover 11 is mounted on the lower cover 110 so as to be adhered to the upper surface of the peripheral portion of the lower cover 110.

Figure 14:
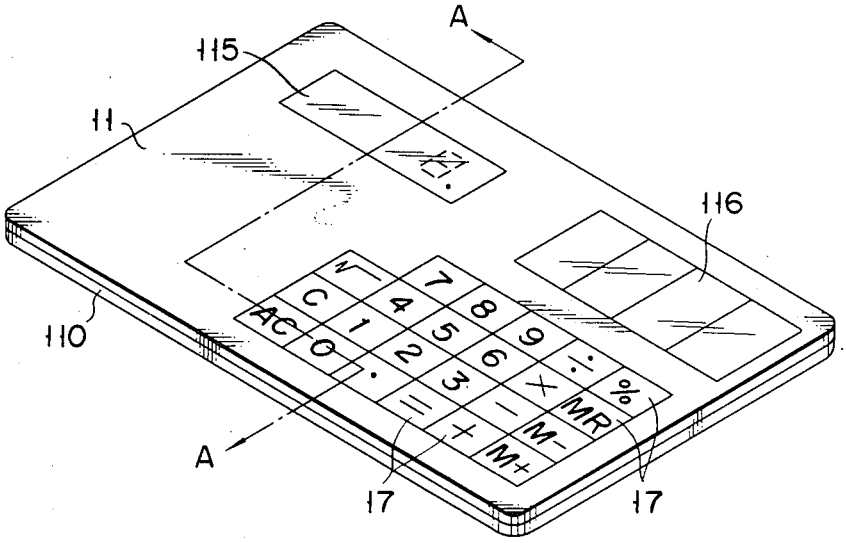
FIG. 14 is a perspective view showing a compact electronic calculator according to a third embodiment of the present invention.
Figure 15:
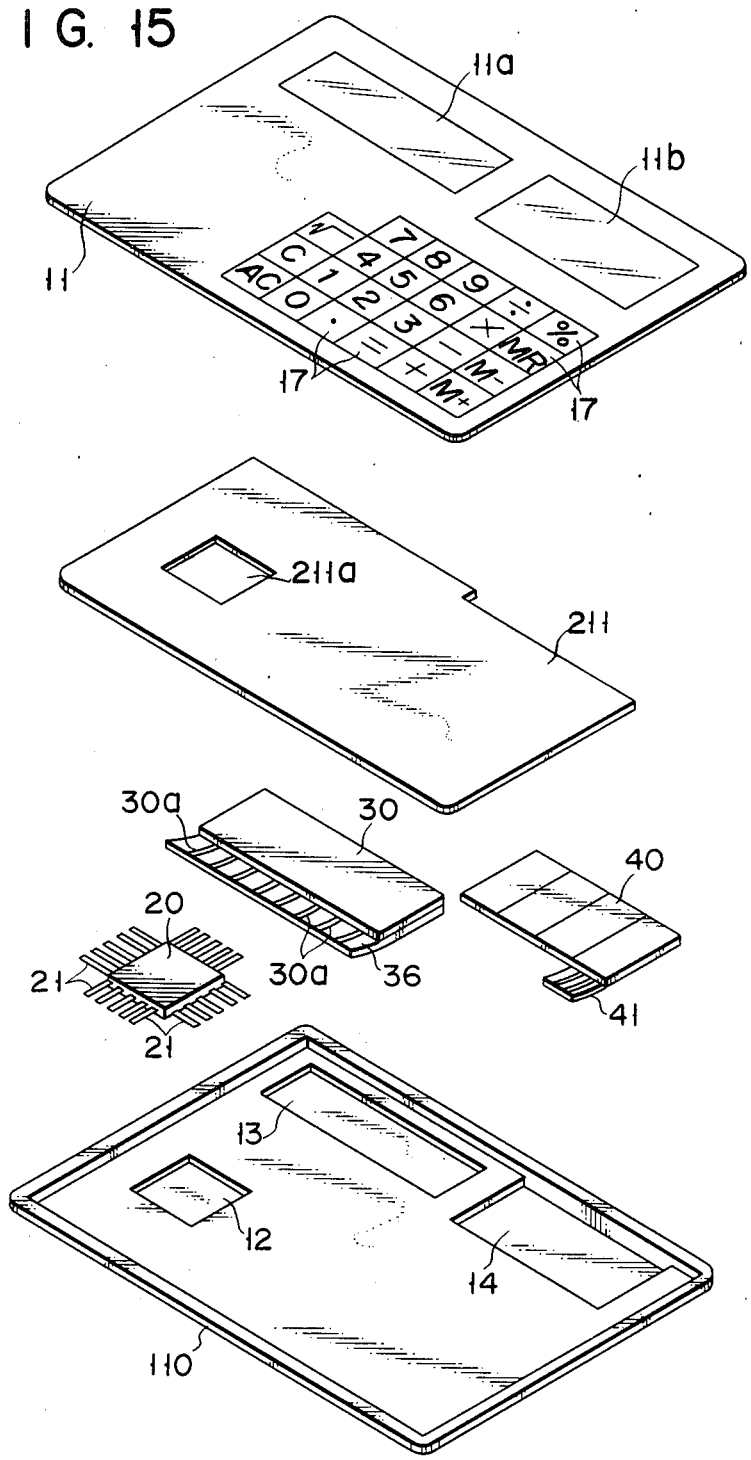
FIG. 15 is an exploded view of the compact electronic calculator shown in FIG. 14.

Referring to FIGS. 14 and 17, reference numeral 60 denotes anisotropically electrical key switches aligned on the lower surface of the board 211. The switches 60 are constituted by key contacts 61 formed on the lower surface of the board 211 so as to face the key symbol printing portions of the upper cover 11, pressure conductive layers 62 printed on (the lower surface of) the key contacts, and lower conductive layers 63' printed on the lower surface of the layers 62 so as to correspond to the contacts 61. The key contacts 61 are commonly connected for each column, as shown in FIG. 15, and the respective key contact columns are connected to a key signal input terminal group KI of the terminals 22 through wirings 51 formed on the lower surface of the board 211.

The lower surface of the board 211 is covered with an insulating synthetic resin adhesive layer 15 excluding the key contacts 61, the arranging portions of the electronic parts (the LSI chip 20, the panel 30 and the cell 40) and the terminals 22, 33, 44*a* and 44*b*. The layers 62 are formed on the key contacts 61 to the same level as that of the insulating layer 15.

The layers 63' are printed on the layer 15 perpendicularly to the key contact columns so as to cover the layers 62 of the respective key contact columns, thus forming a key matrix together with the key contacts 61. The layers 63' are connected to the terminal group KO of the terminals 22 in the following manner.

Referring to FIG. 16, reference numeral 52' denotes lower conductive layer connecting wirings connected from the terminal group KO of the terminals 22 to one side edge portion of the lower cover 110. The wirings 52' are also covered with the insulating layer 15 except for terminal portions 52' thereof. Reference numeral 63'*a* denotes leads of the lower conductive layers 63' printed on the upper surface of the layer 15. The layers 63' are connected to the terminal group KO of the terminals 22 through the wirings 52' so that the edge portions of the wirings 52' are printed to be overlaid on the terminal portions 52'*a*.

FIGS. 18A to 18D and FIGS. 19A to 19D show manufacturing steps of the key switches 60 formed on the lower surface of the board 211. The key switches 60 are formed in the following manner.

Figure 18A:
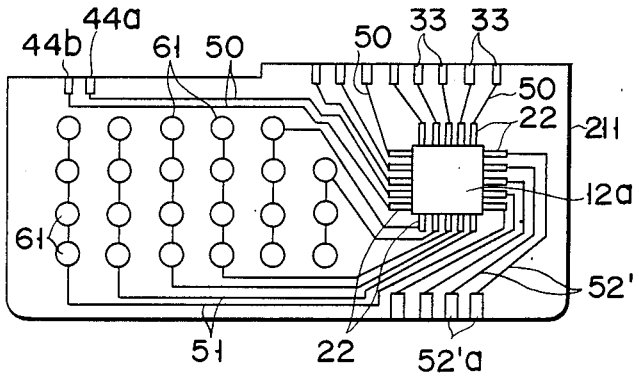
FIGS. 18A to 18D and FIGS. 19A to 19D are respectively plan views and enlarged sectional views showing manufacturing steps of an anisotropically electrical key switch of FIG. 15.
Figure 19A:
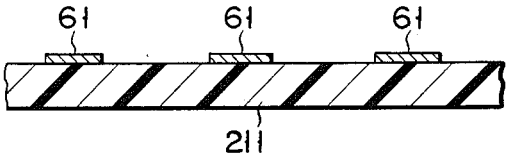

As shown in FIGS. 18A and 19A, a predetermined circuit pattern (wirings 50, 51 and 52') including the key contacts 61 of the switches 60, and the terminals 22, 33, 44*a* and 44*b* for the electronic parts is formed on the lower surface of the board 211 by screen printing of carbon ink. The circuit pattern can be formed so that a copper foil is laminated on the overall lower surface of the board 211 and is patterned by etching.

Figure 18B:
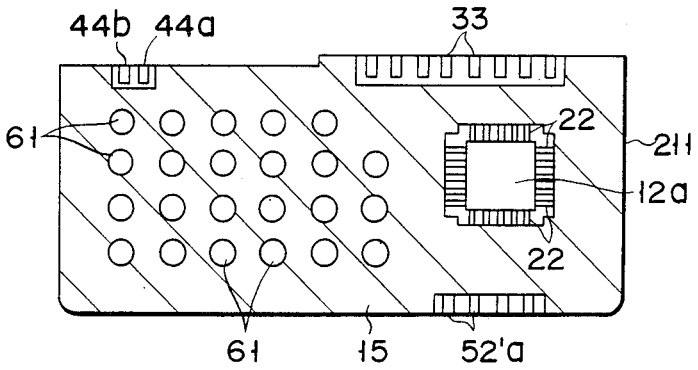
Figure 19B:
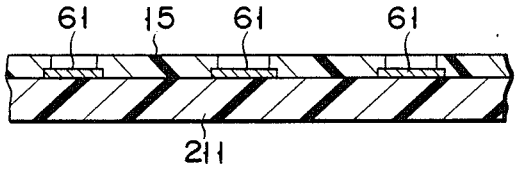

As shown in FIGS. 18B and 19B, an insulating synthetic resin film is printed on the overall lower surface of the board 211 excluding the key contacts 61, the arranging portions of the electronic parts (the LSI chip 20, the panel 30 and the cell 40), the terminals 22, 33, 44*a* and 44*b*, and the terminal portions 52'*a* of the wirings 52', thereby forming the layer 15. The layer 15 is provided for protecting the wirings 50, 51 and 52' formed on the board 211, and for insulating the wirings 50, 51 and 52' from the leads 63'*a* of the layers 63'. The insulating layer 15 can have a thickness of about 30 μm.

Figure 18C:
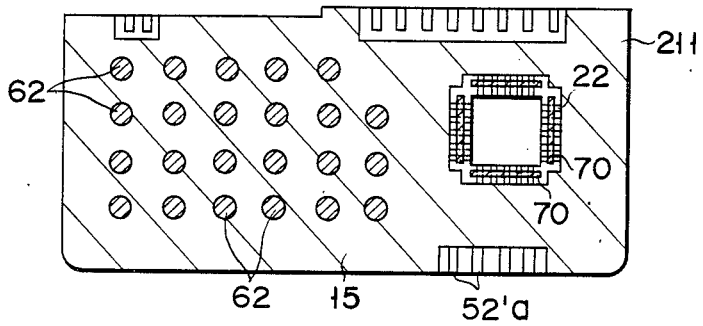
Figure 19C:
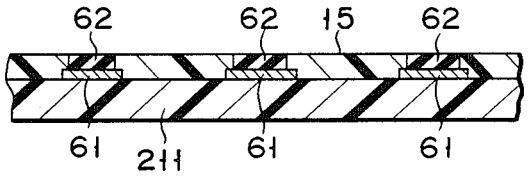

As shown in FIGS. 18C and 19C, the layers 62 are screen printed on the key contacts 61 which are not covered with the layer 15 to the same level as that of the layer 15 (about 30 μm), and anisotropic adhesives 70 are printed on the aligning portion of the terminals 22.

The layers 62 have the same composition and function as in the first embodiment.

Figure 18D:
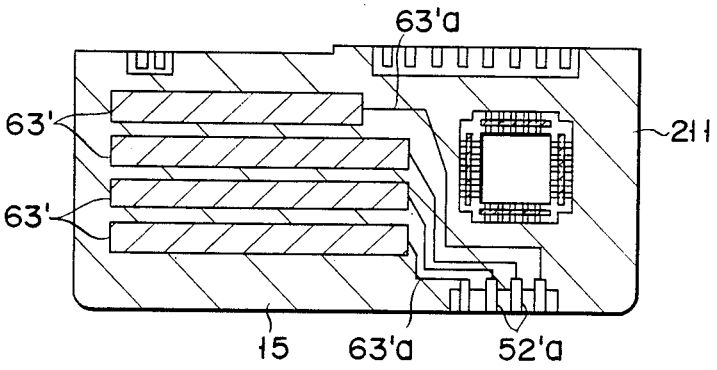
Figure 19D:
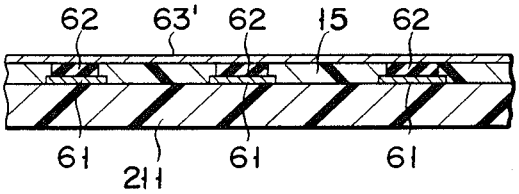
Figure 20:
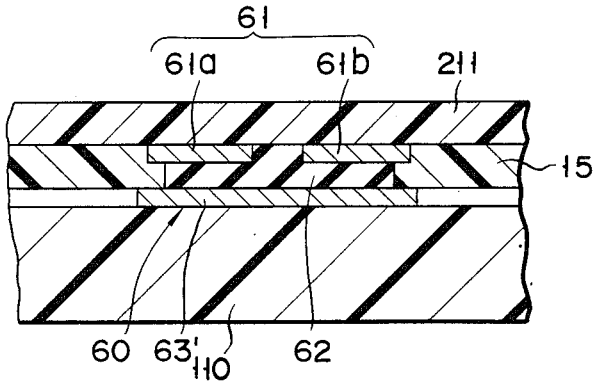
FIGS. 20 and 21 are enlarged sectional views showing different modifications of the anisotropically electrical key switch of FIG. 15.

Thereafter, as shown in FIGS. 18D and 19D, carbon ink is screen printed on the upper surface of the film 15, thus forming the layers 63' covering the layers 62 and the leads 63'*a* thereof. In this case, the edge portions of the leads 63'*a* are printed to be overlaid on the terminal portions 52'*a* of the wirings 52', so that the layers 63' are connected to the terminal group KO of the terminals 22 through the wirings 52'.

Note that when the layers 62 are printed, the adhesives 70 are printed on the aligning portion of the terminals 22. However, the adhesives 70 can be printed after the layers 63' are formed.

When the compact electronic calculator is manufactured, the printed circuit board 211 on which the key switches 60 are formed as described above and to which the LSI chip 20, the panel 30 and the cell 40 are connected is held on the lower cover 110, and the upper cover 11 is adhered thereto so as to be in tight contact with the upper surface of the board 211. When the key symbol 17 is depressed to deform the upper cover 11 and the board 211 downward, the corresponding portion of the layers 62 of the key switches 60 is compressed and exhibits conductivity. Thus, a conductive path is formed between the depressed key contact 61 and the corresponding layer 63' so as to be selectively turned on. A keying signal is supplied to the LSI chip 20 through the respective wirings and terminals, and is used for a desired calculation. In addition, the keying signal is used for displaying the corresponding calculation result on the panel 30.

According to the key switch structure of this embodiment, since the key switches 60 are formed by sequentially printing the key contacts 61 and the layers 62 and 63' on the lower surface of the board 211, the key switches can be easily formed unlike a coventional key switch structure in which anisotropically electrical conductive rubber sheets are aligned to be stacked, thus allowing easy assembly of the compact electronic calculator.

According to the key switch strucure of this embodiment, since the layers 62 are formed by printing in the same manner as as in the first embodiment, they need not be formed thick to prevent formation of wrinkles or damage unlike the pressure sensitive conductive rubber sheet considered as one component. Therefore, the layers 62 can be formed to be thin and the total thickness of the key switches can be greatly decreased, thus providing a very thin compact electronic calculator.

Figure 21:
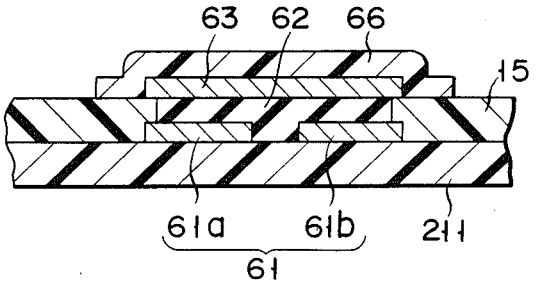

Note that in the third embodiment, the board 211 is depressed through the upper cover 11 of the electronic calculator so as to compress the layers 63'. However, as shown in FIG. 21, the board 211 can be also used as the upper cover 11, and the lower cover 110 can be omitted. In this case, key symbols (not shown) are printed on the upper surface of the board 211, and the board 211 is directly depressed.

In the third embodiment, the key contacts of the key switches 60 are connected to the key signal input terminals of the LSI chip 20, and the layers 63' are connected to the key signal output terminals of the LSI chip 20. However, the key contacts 61 of the key switches 60 on the lower cover 110 can be formed by a pair of contact electrodes (ex, comb figure electrodes) 61*a* and 61*b*, and the electrodes 61*a* can be connected to the key signal input terminals and the electrodes 61*b*, to the signal output terminals. Thus, the electrodes 61*a* are made conductive through the layers 62 and the layers 63' printed thereon. Note that in this case, no lead is required from the layers 63'.

Furthermore, in the third embodiment, the key switches are formed on the lower surface of the board 211. However, the key switches 60 can be formed on the upper surface of the board 211. In this case, the layers 63' are independently coated with an insulating resin. Then, key symbols (not shown) are printed on the upper surface of the coating films 66, or an upper sheet on which key symbols are printed can be laminated on the upper surface of the board 211. In this case, the board 211 can be a hard material.

In the third embodiment, the key switch structure using the solar cell as a power source cell has been explained. The present invention can be applied to a key switch structure of a compact electronic calculator using a paper-like cell. Alternatively, the present invention can be applied to a key switch structure of compact electronic equipment other than the compact electronic calculator.

According to the present invention, key switches of anisotropically electrical type can be easily manufactured, and can be formed to be thin as compared to conventional key switches.

What is claimed is:

1. A method for fabricating a key switch comprising the steps of:

forming a first conductive layer on a first surface;

forming connecting terminals on said first surface;

forming a first conductive pattern on said first surface for connecting said first conductive layer with some electrodes of an electronic component and for connecting other electrodes of the electronic component with said connecting terminals;

forming an insulating layer covering said first conductive pattern but leaving the connecting terminals and the first conductive layer exposed;

forming a plurality of anisotropically electrical conductive islands on said first conductive layer;

forming a second conductive layer on said islands; and forming a second conductive pattern on a side of said insulating layer opposite from the first conductive pattern for connecting said second conductive layer to said connecting terminals.

2. The method of claim 1, further comprising the steps of providing a first and a second cover to enclose said surface with one of said first and second covers being made of a flexible material, and forming a plurality of key indicia exposed on the flexible one of said first and second covers.

3. The method of claim 2, wherdin said steps of forming said first conductive pattern and said second conductive pattern includes forming a key matrix for identifying any one of said plurality of key indicia.

4. The method of claim 3, wherein the step of forming said first conductive layer comprises forming a plurality of conductive areas in contact, respectively, with said conductive islands.

5. The method of claim 4, wherein the step of forming said second conductive layer comprises forming strips overlying a plurality of said conductive islands.

6. The method of claim 5, wherein the step of forming said key matrix comprises forming a plurality of said conductive areas electrically connected to each other to form a row with each of said strips overlying a plurality of rows to form a column.

7. The method of claim 6, wherein each of said islands is formed on a conductive area.

8. The method of claim 7, wherein said first cover is an upper cover and said second cover is a lower cover.

9. The method of claim 8, wherein said surface is an inner surface of said second cover.

10. The method of claim 8, wherein said surface is an inner surface of said first cover.

11. The method of claim 8, wherein said surface is on a board accommodated between said first and second covers.

12. The method of claim 11, wherein said board is flexible.

13. The method of claim 2, wherein said first cover is an upper cover and said second cover is a lower cover.

14. The method of claim 13, wherein said surface is an inner surface of said second cover.

15. The method of claim 13, wherein said surface is an inner surface of said first cover.

16. The method of claim 13, wherein said surface is on a board accommodated between said first and second covers.

17. The method of claim 16, wherein said substrate is flexible.

18. The method of claim 1, wherein the step of forming said first conductive layer comprises forming a plurality of conductive areas in contact, respectively, with said conductive islands.

19. The method of of claim 18, wherein the step of forming said second conductive layer comprises forming strips overlying a plurality of said conductive islands.

20. The method of of claim 18, wherein each of said islands is formed on a conductive area.

21. A compact electronic device, comprising:

a first cover having an outer surface, said first cover being flexible;

a second cover having an outer surface, said second cover being rigid and having cavities for respectively receiving integrated circuit chip and display panel arrangement sections;

a plurality of anisotropically electrical conductive islands arranged on a support surface between said outer surfaces, respectively, of the first and second covers, each of said islands having two opposed ends facing, respectively, said first and second covers;

a first conductive layer contacting one end of said islands and positioned between said islands and one of said first and second covers;

a second conductive layer contacting the other end of said islands and positioned between said islands and the other of said first and second covers;

connecting terminals arranged on the peripheries of said cavities for said integrated circuit chip and display panel arrangement sections;

conductive pattern means formed on said support surface for connecting at least one of said first and second conductive layers with said connecting terminals;

an insulating layer covering said conductive pattern while leaving said connecting terminals exposed;

an integrated circuit chip which is arranged in the respective cavity for receiving said integrated circuit chip arrangement section, said integrated circuit chip having electrodes which are connected to some of said connecting terminals; and a display panel which is arranged in the respective cavity for receiving said display panel arrangement section, said display panel having electrodes which are connected to other of said connecting terminals.

22. The compact electronic device of claim 21, wherein said first cover has a plurality of key indicia exposed thereon, said indicia being aligned with said islands.

23. The compact electronic device of claim 21, wherein said support surface is an inner surface of said second cover.

24. The compact electronic device of claim 23, wherein said anisotropically electrical conductive islands, said first conductive layer, said second conductive layer, said connecting terminals, said conductive pattern means and said insulating layer are all formed on said support surface.

25. The compact electronic device of claim 21, wherein said support surface is an inner surface of said first cover.

26. The compact electronic device of claim 21, wherein said anisotropically electrical conductive islands, said first conductive layer, said second conductive layer, said connecting terminals, said conductive pattern means and said insulating layer being all formed on said support surface.

27. A compact electronic device, comprising:

a first cover having an outer surface, said first cover being flexible;

a second cover having an outer surface, said second cover being rigid;

a plurality of anisotropically electrical conductive islands arranged on a support surface between said outer surfaces, respectively, of the first and second covers, each of said islands having two opposed ends facing, respectively, said first and second covers;

a plurality of first conductive patterns each of which has a number of key input terminals contacting one end of said islands, a pattern connecting terminal, and a chip connecting terminal;

a plurality of second conductive patterns each of which has a number of key input terminals contacting the other end of said islands and a chip connecting terminal, and being connected to said pattern connecting terminal;

an integrated circuit chip carried on said second cover, said integrated circuit chip having electrodes which are connected to the chip connecting terminals; and an insulating layer for covering at least said first conductive patterns while leaving said second conductive patterns and chip connecting terminals exposed.

28. The compact electronic device of claim 27, wherein said first cover has a plurality of key indicia exposed thereon, said indicia being aligned with said islands.

29. The compact electronic device of claim 28, wherein said support surface is an inner surface of said second cover.

30. The compact electronic device of claim 28, wherein said anisotropically eelctrical conductive islands, said first conductive patterns, said second conductive patterns, said connecting terminals, and said insulating layer are all formed on said support surface.

31. The compact electronic device of claim 28, wherein said support surface is an inner surface of said first cover.

32. The compact electronic device of claim 28, wherein said support surface is on a board arranged between said first and second covers.

33. The compact electronic device of claim 27, wherein said anisotropically electrical conductive islands, said first conductive patterns, said second conductive patterns, said connecting terminals, and said insulating layer are all formed on said support surface.

34. The compact electronic device comprising:

a substrate, said substrate being substantially rigid;

a plurality of first key input terminals formed on said substrate;

a plurality of anisotropically electrical conductive islands printed on each of said first key input terminals;

conductive pattern means formed on said substrate, including a plurality of connecting terminals connected to said islands;

a first insulating layer for covering said conductive pattern means while leaving said connecting terminals exposed, said first insulating layer having substantially the same outer surface as said islands;

a plurality of second key input terminals connected to the outer surface of each of said islands;

an integrated circuit chip which is carried on said substrate and having electrodes which are connected to said connecting terminals; and a second insulating layer for covering said first insulating layer, said second key input terminals and said integrated circuit chip.

35. The compact electronic device of claim 34, wherein said second insulating layer is formed of a flexible sheet member.

36. The compact electronic device of claim 35, wherein said flexible sheet member has a plurality of key indicia exposed thereon, said indicia being aligned with said islands.

37. The compact electronic device of claim 34, wherein said second insulating layer is a coating of an insulating resin.

38. The compact electronic device of claim 37, wherein said connecting terminals and the electrodes of said integrated circuit chip are connected to each other by means of an anisotropically electrical conductive material.

39. The compact electronic divice of claim 38, wherein said some of said connecting terminals are connected to electrodes of a display panel held in said substrate.

40. The compact electronic device of claim 39, wherein said connecting terminals and said electrodes of said display panel are connected to each other by means of an anisotropically electrical conductive material.

41. The compact electronic device of claim 34, wherein said second insulating layer has a plurality of conductive leads thereon for connecting each of said second key input terminal to respective electrodes of said integrated circuit chip.

42. The compact electronic device of claim 41, wherein said connecting terminals include some of said conductive leads, and said conductive leads have a portion which is formed on the associated connecting terminal for lead connection.

* * * * *